US006340258B2

(12) United States Patent
Gueret

(10) Patent No.: US 6,340,258 B2
(45) **Date of Patent: *Jan. 22, 2002**

(54) DISPENSER FOR DISPENSING A STICK OF PRODUCT

(75) Inventor: Jean-Louis H. Gueret, Paris (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/350,911

(22) Filed: Jul. 12, 1999

(30) Foreign Application Priority Data

Jul. 10, 1998 (FR) ..... 98 08936

(51) Int. Cl.[7] ..... A45D 40/06

(52) U.S. Cl. ..... 401/87; 401/54; 401/68; 401/98

(58) Field of Search ..... 401/54, 81, 98, 401/86, 206, 87, 88, 68

(56) References Cited

U.S. PATENT DOCUMENTS

| | | | | | |
|---|---|---|---|---|---|
| 2,013,308 | A | * | 9/1935 | Hickox | 401/61 |
| 2,491,721 | A | * | 12/1949 | Gelardin | 401/79 |
| 2,704,153 | A | | 3/1955 | Florman | |
| 2,789,692 | A | * | 4/1957 | Ferri | 401/53 |
| 3,589,821 | A | * | 6/1971 | Barney | 401/75 |
| 5,167,462 | A | | 12/1992 | Lucas | |
| 5,234,275 | A | * | 8/1993 | Gueret | 401/78 |
| 5,277,508 | A | * | 1/1994 | Gueret | 401/87 |
| 5,549,404 | A | * | 8/1996 | Kageyama et al. | 401/75 |

(List continued on next page.)

FOREIGN PATENT DOCUMENTS

| | | |
|---|---|---|
| EP | 0 504 050 | 9/1992 |
| FR | 805 950 | 12/1936 |
| FR | 1 193 220 | 10/1959 |
| FR | 1 261 214 | 9/1961 |
| JP | S60-158513 | 10/1985 |
| JP | 61-151609 | 9/1986 |
| JP | S62-33714 | 2/1987 |
| JP | H7-16711 | 3/1995 |
| JP | 09056462 | 3/1997 |
| JP | 09056465 | 3/1997 |

OTHER PUBLICATIONS

Complete English translation of Japanese Patent Publication No. H7–16711.

English translation of FR 1 193 220, published Oct. 30, 1959.

(List continued on next page.)

*Primary Examiner*—Gregory L. Huson
*Assistant Examiner*—Peter deVore
(74) *Attorney, Agent, or Firm*—Finnegan, Henderson, Farabow, Garrett & Dunner, LLP

(57) ABSTRACT

A dispenser for dispensing a stick of product includes a holder configured to hold the stick of product and a housing containing the holder. The housing has a first end, a second end, and an opening in the first end. The housing is configured to move the holder in a first direction toward the opening to allow dispensing of the product and in a second direction away from the opening to allow storage of the product. The dispenser further includes a removable closure configured to sealably close the opening during storage of the product. A sealing member is provided for sealing at least a portion of the housing between the holder and the opening from at least a portion of the housing between the holder and the second end. The dispenser also includes an elastic member between the holder and the second end of the housing. The elastic member is configured to deform and thereby allow for movement of the holder in the second direction when excessive pressure is formed between the holder and the opening. Methods of limiting excessive pressure in a dispenser are also disclosed.

47 Claims, 4 Drawing Sheets

U.S. PATENT DOCUMENTS

| | | | | | |
|---|---|---|---|---|---|
| 5,715,961 | A | * | 2/1998 | Robertson | 215/319 |
| 5,746,530 | A | * | 5/1998 | Oota | 401/88 |
| 5,842,802 | A | * | 12/1998 | Lang et al. | 401/68 |
| 5,871,295 | A | * | 2/1999 | Bouix | 401/78 |
| 5,984,554 | A | | 11/1999 | Bouix | |

OTHER PUBLICATIONS

English abstract of JP H7–16711, Patent Abstracts of Japan, JPO.

English abstract of JP 090 56465, Patent Abstracts of Japan, JPO.

English abstract of JP 09056462, Patent Abstracts of Japan, JPO.

English translation of the claim of JP S60–158513.

English translation of the claim of JP S62–33714.

Patent Abstracts of Japan, vol. 097, No. 007, Jul. 31, 1997 (JP 09 056461).

Patent Abstracts of Japan, vol. 096, No. 012, Dec. 26, 1996 (JP 08 214938).

*English translation of JP S61–151609*, published Sep. 19, 1986.

* cited by examiner

DISPENSER FOR DISPENSING A STICK OF PRODUCT

The present invention relates to a dispenser for dispensing a stick of product, for example, a lipstick, a stick of foundation, a stick of treatment composition, or a stick of moisturizing composition. The dispenser of the present invention is particularly suited for use with sticks of product containing highly volatile solvents (e.g., silicones). For example, such solvents are commonly used in lipsticks.

In conventional dispensers, sticks of product are packaged in a cylindrical tube containing a platform. The platform is generally configured to support a stick of product and to move axially within the tube in response to an actuating input, between a product storage position and a product application position. A mechanism is provided to control movement of the platform within the tube. For example, conventional dispensers sometimes use a mechanism including a threaded rod positioned under the platform and a wheel attached to the rod, wherein the wheel is rotated to move the rod and platform within the tube. Conventional dispensers also sometimes use a helical ramp formed in a wall of the tube to facilitate movement of the platform. A cover is generally provided on the cylindrical tube to seal the tube and thereby prevent the product from drying out.

Although some conventional product-stick dispensers are relatively reliable, they sometimes suffer from problems associated with pressure "build up" in the cylindrical tube. When the cover is positioned on the tube to seal off the tube from outside air, pressure in a portion of the tube above the platform sometimes increases above atmospheric pressure. The increased pressure is sometimes caused when the engagement of the cover on the tube compresses air in the tube. Increased pressure also results from increased temperature in the tube, for example, when the dispenser is left in direct sunlight. Regardless of the way in which increased pressure is generated in a dispenser, this phenomenon is hereinafter referred to as "excessive pressure."

In conventional dispensers, excessive pressure in the tube occasionally reaches a level that can cause the cover to unseal from the tube. If a cover is left unsealed for even a short time, a product stick including a highly volatile solvent (such as lipstick) can dry out and become unusable. Dispensers having a cover that provides a very tight seal over the tube can limit the occurrence of cover unsealing, but consumers prefer a dispenser having a cover that can be easily removed from the tube. Conventional dispensers have failed to satisfy the need for a dispenser having a cover that is easy to remove, but that remains on the tube, even when the tube experiences an excessive pressure condition caused by replacing the cover on the tube or increasing the temperature inside the tube.

In light of the foregoing, there is a need in the art for an improved dispenser for dispensing a stick of product.

Accordingly, the present invention is directed to dispensers and methods of applying a stick of product using dispensers that obviate one or more of the short-comings of the related art.

A preferred object of the invention is to provide a dispenser for the sealed packaging and dispensing of a stick of product that is simple and inexpensive to produce, while still providing a reliable seal for the dispenser and stick of product.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a dispenser for dispensing a stick of product including a holder configured to hold the stick of product and a housing containing the holder. The housing has a first end, a second end, and an opening in the first end. The housing is configured to move the holder in a first direction toward the opening to allow dispensing of the product and in a second direction away from the opening to allow storage of the product. The dispenser further includes a removable closure configured to sealably close the opening during storage of the product. A sealing member is provided for sealing at least a portion of the housing between the holder and the opening from at least a portion of the housing between the holder and the second end. The dispenser also includes an elastic member between the holder and the second end of the housing. The elastic member is configured to deform and thereby allow for movement of the holder in the second direction when excessive pressure is formed between the holder and the opening.

In another aspect, the housing includes a first section and a second section rotatable with respect to one another. The first and second sections are preferably configured so that rotation of the first section in one direction moves the holder in the first direction and rotation of the first section in an opposite direction moves the holder in the second direction.

The elastic member preferably allows the holder to move toward the second end of the housing to absorb at least a portion of excessive pressure between the holder and the opening. By limiting the amount of excessive pressure, the elastic member enables the closure to reliably seal the opening in the first end of the housing while permitting a user to easily remove the closure from the housing during use of the dispenser.

In one embodiment, the sealing member is a sealing lip on an edge of the holder. In another embodiment, the sealing member is an O-ring or any other type of structure that provides a seal between two elements that move with respect to one another. The sealing member preferably seals the stick of product from at least a portion of the housing between the holder and the second end that is not sealed from outside air. When the closure seals the opening on the housing, the stick of product is preferably sealed from outside air and contaminants that dry out the product.

Preferably, the elastic member includes a block of foam and/or an elastomeric material that is deformable. When the elastic member includes the block of foam, the block of foam preferably is chosen from at least one of polyvinyl chloride foam, polyurethane foam, polyether foam, synthetic rubber foam (e.g., SBR), and natural rubber foam (e.g., NBR). When the elastic member includes the elastomeric material, the elastomeric material is preferable chosen from at least one of silicone elastomers, nitrile elastomers and an elastomeric material sold under the brand name Polynorbordene®. In an alternate embodiment, the elastic member is a spring, for example, a helical spring. In still another embodiment, the elastic member has the shape of a bellows. Many other types of elastic members are also within the scope of the present invention.

The dispenser may include a sealing element configured to cooperate with the removable closure to sealably close the opening during storage of the product. Optionally, the closure may include a sealing element configured to sealably close the opening. Optionally, the closure includes a thermoplastic insert that seals the opening in the first end of the housing from outside air.

Preferably, the housing includes a sleeve configured to contain the holder and an actuating member coupled to the sleeve so that the actuating member is capable of rotating relative to the sleeve.

The dispenser preferably includes a threaded member coupled to the holder and a receiving member having threads configured to engage the threads of the threaded member. Preferably, the holder moves in the first direction and in the second direction when the receiving member is rotated relative to the threaded member. Preferably, the threaded member is a rod and the receiving member is a nut. In the alternative, the movement of the holder is achieved by a helical-ramp mechanism, like those included on conventional dispensers, such as lipstick dispensers.

Preferably, the receiving member is coupled to the actuating member to preclude relative rotation therebetween. The threaded member is preferably coupled to the sleeve to preclude relative rotation therebetween. In one embodiment, the threaded member has a non-circular cross-section (e.g., a threaded rod having two flat sides over at least part of its length) and is coupled to the sleeve by a guiding member of corresponding cross-section. In the alternative, when the sealing member is an O-ring, the sealing member may couple the threaded member to the sleeve by friction, thereby preventing relative rotation therebetween.

In yet another embodiment, the receiving member is a nut that is supported by the elastic member. A first end of the elastic member preferably supports the nut and a second end of the elastic member is preferably on a bottom portion of the actuating member. By way of example, the elastic member may contact a bottom portion of the actuating member or it may contact a stopping member on the actuating member. Preferably, the elastic member and the receiving member are integral, for example, they are a single-piece formed by thermoplastic molding.

Preferably, the holder includes a vent near a lower portion of the holder. The vent preferably allows air to flow out of the holder when a stick of product is positioned on the holder.

The dispenser is preferably used for the dispensing of a lipstick, a stick of foundation, and a stick of treatment and/or moisturizing composition.

In another aspect, the invention includes a dispenser for dispensing a stick of product including a housing having a first portion and a second portion coupled together so that the first and second portions are rotatable with respect to one another. A removable closure is configured to sealably close an opening in the second portion of the housing. A holder configured to hold a stick of product is also provided. The holder is in the housing and is coupled to the housing so that rotation of the first portion with respect to the second portion provides dispensing movement of the holder toward the opening and storage movement of the holder away from the opening. An elastic member positioned in the housing is coupled to the holder so that excessive pressure in the housing causes deformation of the elastic member to allow pressure absorption movement of the holder, with respect to the first and second portions, in a direction away from the opening.

In still another aspect, the invention includes a method of limiting excessive pressure in a dispenser similar to the dispensers described above. The method includes removing the closure from the housing. The product is then applied to a surface. After applying the product, the closure is replaced on the housing to sealably close the opening. As excessive pressure develops between the holder and the opening, the elastic member is deformed to thereby absorb at least a portion of the excessive pressure.

In a further aspect, the method includes moving the holder axially within the housing after the closure is removed to expose the stick of product from the housing and then moving the holder axially within the housing to store the stick of product after applying the product to the surface.

Besides the structural arrangements set forth above, the invention could include a number of other arrangements, such as those explained hereinafter. It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIGS. 1A and 1B show a first embodiment of a dispenser for dispensing a stick of product;

Figure 1A:
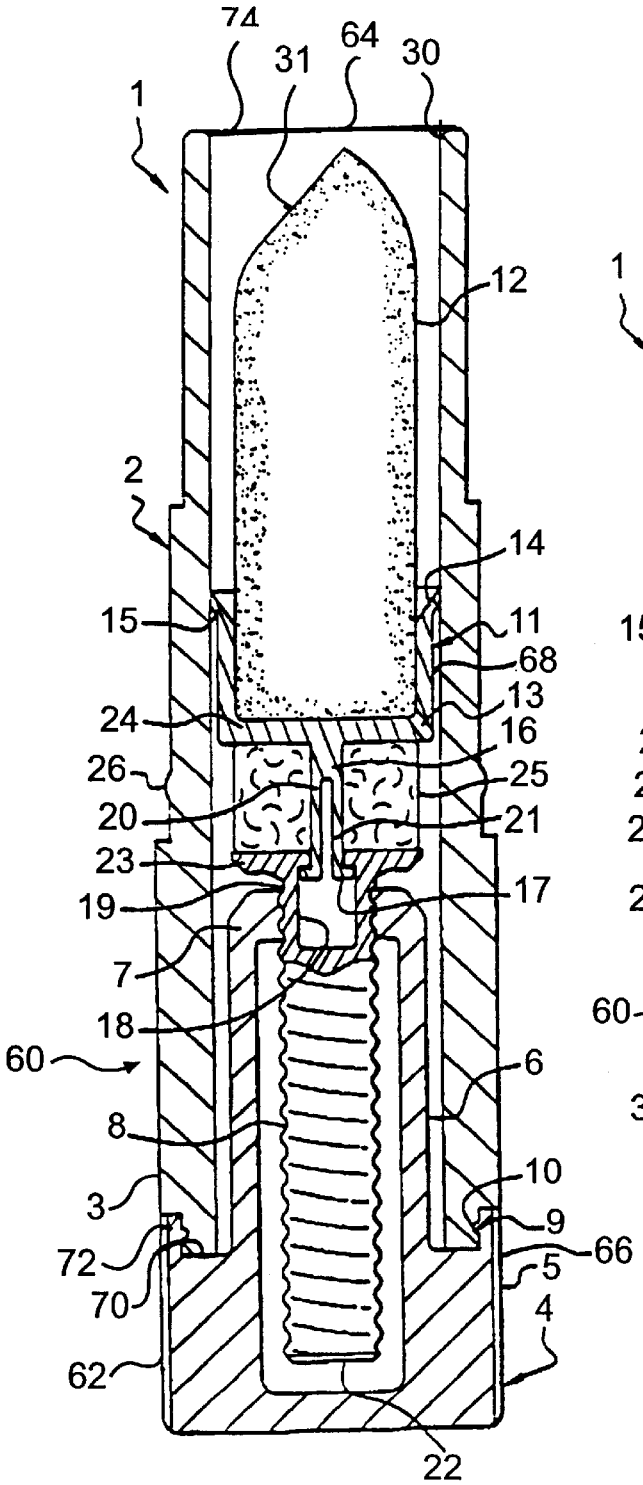

Reference will now be made in detail to the present preferred embodiments of the invention, examples of which are illustrated in the accompanying drawings. Wherever possible, the same reference numbers are used in the drawings and the description to refer to the same or like parts. In addition, alphabet suffixes on reference numerals are used to refer to similar parts.

Figure 1B:
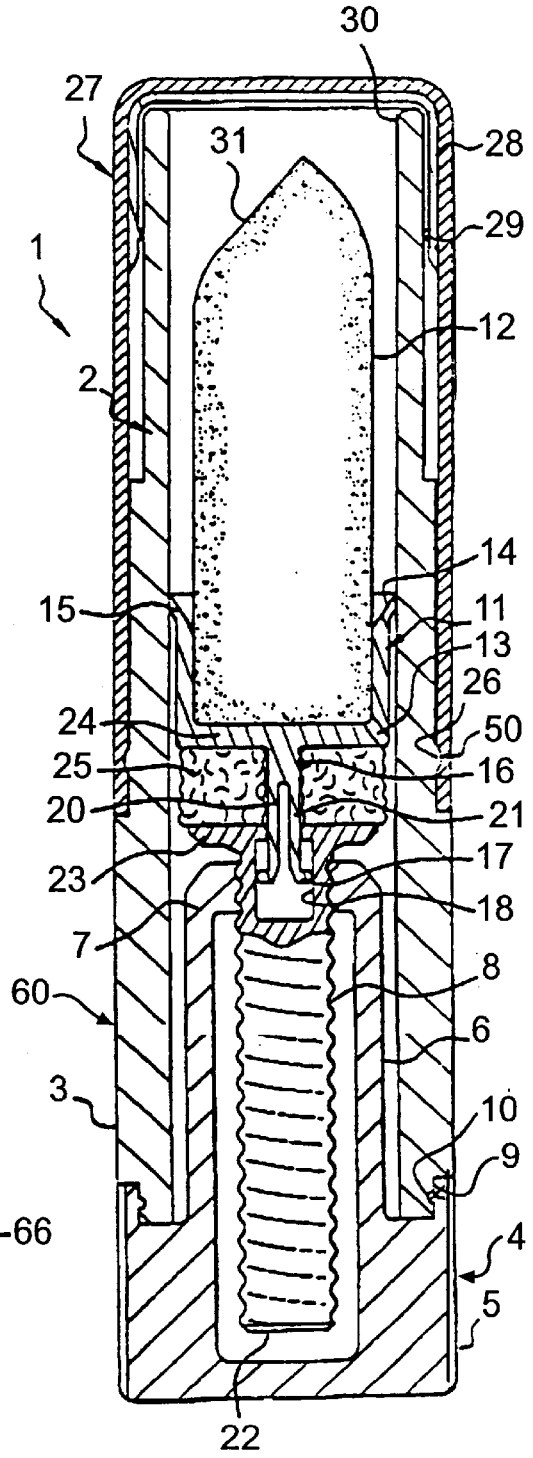

As shown in FIGS. 1A and 1B, a dispenser 1 comprises a holder 11 and a housing 60. The holder 11 preferably holds a stick of product 12. Preferably, the stick of product 12 is a lipstick. The housing 60 preferably includes a sleeve 2 configured to contain the holder 11 and stick of product 12, and an actuating member 4 coupled to the sleeve 2 so that the actuating member 4 is capable of being rotated relative to the sleeve 2. Preferably, the sleeve 2 has a cylindrical cross-section. A lower end 3 of the sleeve 2 is preferably on the actuating member 4. An upper end 30 of the sleeve 2 defines a first end 64 of the housing 60, including an opening 74. The actuating member 4 defines a second end 62 of the housing 60. A removable closure 27, shown in FIG. 1B, is provided for selectively sealing the opening 74. The sleeve 2 preferably includes a rib 26 on an outer surface of the sleeve 2 for engaging a corresponding groove 50 on an inner surface of the closure 27 to allow the closure 27 to be removably fastened to the sleeve 2. The closure 27 preferably includes a thermoplastic insert 28 positioned inside of the closure 27. In a preferred embodiment, the insert 28 is made of polyethylene. The insert 28 preferably has a rim 29 on an inner surface of the insert 28 configured to seal the opening 74 by contacting an outer surface of the sleeve 2 near the first end 64, when the closure 27 is on the sleeve 2.

The actuating member 4 preferably includes ribs 5 on a side wall 66 of the actuating member 4 to facilitate gripping of the actuating member 4. In a preferred embodiment, the actuating member 4 has a cylindrical cross-section. A flange 72 preferably extends from a top surface 70 of the actuating member 4, parallel to the side wall 66. Preferably, an inner surface of the flange 72 includes a rim 9 configured to engage a corresponding slot 10 on the sleeve 2 near the lower end 3. The rim 9 is preferably configured to snap-fit onto the slot 10. When the rim 9 is on the slot 10, the outer surface of the actuating member 4 is preferably aligned substantially with the outer surface of the sleeve 2 and the actuating member 4 is capable of rotating relative to the sleeve 2.

A skirt 6 having an outside diameter smaller than an inside diameter of the sleeve 2 extends from the top surface 70 of the actuating member 4 into the sleeve 2. The length of the skirt 6 is preferably selected so that the skirt 6 extends into the sleeve 2 by a length of approximately ⅓ of the axial length of the sleeve 2. Preferably, the skirt 6 defines a receiving space within the actuating member 4, configured to receive a threaded member 8. An upper portion of the skirt 6 preferably includes a receiving member 7 having threads configured to engage the threads of the threaded member 8. Preferably, the threaded member 8 is a threaded rod. The threaded member 8 allows for movement of the holder 11 within the sleeve 2 when the threads of the receiving member 7 are engaged to the threads of the threaded member 8 and the receiving member 7 is rotated relative to the threaded member 8. In a preferred embodiment, the receiving member 7 is a threaded nut.

Preferably, the holder 11 is cup-shaped and has a lower portion 24 and at least one side wall 68. The holder 11 preferably includes an orifice defining a vent 13 adjacent to the lower portion 24 of the holder 11 for expelling air trapped between the stick of product 12 and the holder 11 when the stick of product 12 is positioned on the holder 11. A free edge 15 of the side wall 68 preferably includes a sealing member 14 flaring outwardly from the side wall 68, for providing a seal between an outer surface of the side wall 68 and the inner surface of the sleeve 2. Preferably, the sealing member 14 is a sealing lip. In an alternative embodiment, the sealing member 14 is an O-ring on at least one of the sleeve 2 and the holder 11. Because the sealing member 14 contacts the inner surface of the sleeve 2, the sealing member 14 preferably limits the holder 11 from rotating relative to the sleeve 2.

A stem 16 having a catch 17 preferably extends from the lower portion 24 of the holder 11. An end 19 of the threaded member 8 preferably has a cut-out 18 configured to receive the stem 16. Preferably, the catch 17 is positioned in the cut-out 18 by elastically deforming fingers 20, 21 of the stem 16. The profile of the catch 17 is preferably configured to allow the catch 17 to move axially between ends of the cut-out 18, but not rotationally relative to the threaded member 8.

Figure 4:
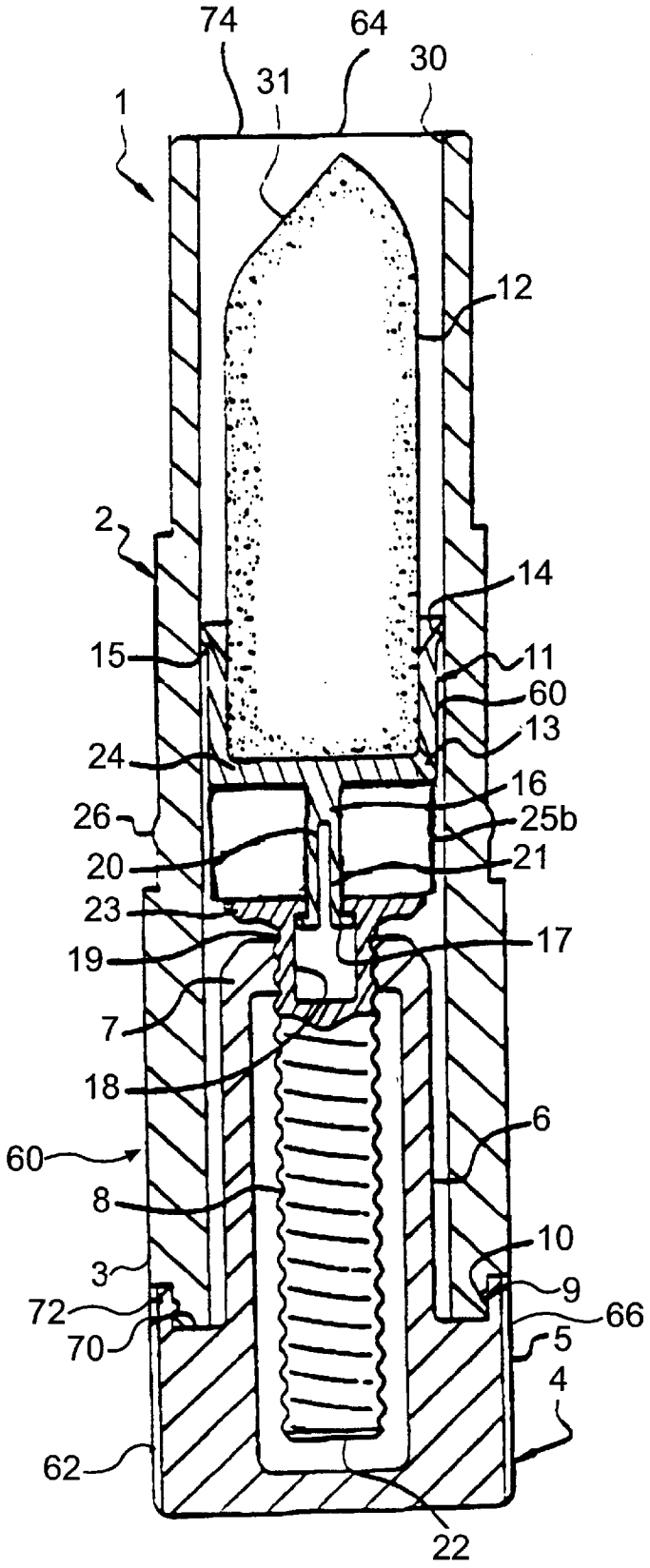
FIG. 4 shows an embodiment of a dispenser with an elastic member having a bellows shape according to an aspect of the invention.

Preferably, an end 22 of the threaded member 8 (substantially opposite to the end 19) extends nearly to a bottom portion of the actuating member 4 when the holder 11 is in the storage position. A transverse plate 23 is preferably provided on the end 19 of the threaded member 8. An elastic member 25 is preferably positioned between the lower portion 24 of the holder 11 and the transverse plate 23. Preferably, the elastic member 25 is a block of foam 25, for example, a block of foam made of polyurethane. Alternatively, the elastic member may have a bellows configuration 25*b*, as shown in FIG. 4. In one embodiment, the elastic member 25 is a block of foam having an axial height of about 1 cm. A taller block of foam generally provides more gradual absorption of excessive pressure than a shorter block of foam. Alternatively, the elastic member 25 is a spring, for example, a helical spring. The elastic member 25 preferably includes an opening configured to allow the stem 16 to pass through the opening. Preferably, the elastic member 25 has an outside diameter slightly less than the inside diameter of the sleeve 2 to allow clearance between the elastic member 25 and the inner surface of the sleeve 2. The elastic member 25 is preferably configured to have a compression resistance that is less than a catching force between the groove 50 of the closure 27 and the rib 26 of the sleeve 2, so that the elastic member 25 at least partially absorbs excessive pressure in the sleeve 2 caused by replacing the closure 27 on the sleeve 2.

In an alternate embodiment, the threaded member 8 is rotatably coupled to the sleeve 2 by a rib on the transverse plate 23 that slides inside a longitudinal slot on the inner surface of the sleeve 2. This alternate configuration does not require rotational coupling of the threaded rod 8 to the holder 11.

To use the dispenser 1, the user first removes the closure 27. Next, the user moves the stick of product 12 from the storage position to the dispensing position by rotating the actuating member 4 relative to the sleeve 2. Rotating the actuating member 4 causes the threaded engagement between the receiving member 7 and threaded member 8 to move the threaded member 8 axially relative to the receiving member 7. When the threaded member 8 is moved upwardly within the sleeve 2, the transverse plate 23 of the threaded member 8, in turn, moves the elastic member 25 and the holder 11 axially upwardly. The user continues to rotate the actuating member 4 until a free surface 31 of the stick of product 12 emerges from the opening 74. Then, a user applies the product (e.g., lipstick) to a surface, such as the skin (e.g., lips) of the user. After applying the product, the user rotates the actuating member 4 in the opposite direction to return the stick of product 12 to its storage position within the sleeve 2. Next, the user re-positions the closure 27 on the sleeve 2.

Because of the seal created under the holder 11 by the sealing member 14 and the seal created above the holder 11 by the rim 29 of the insert 28, air trapped within the sleeve 2 between the opening 64 and the sealing member 14 is compressed. This compression causes excessive pressure within the sleeve 2. However, because the elastic member 25 has a compression resistance that is less than the catching force between the groove 50 of the closure 27 and the rib 26 of the sleeve 2 (i.e., the elastic member 25 compresses before the excessive pressure forces the closure 27 away from opening 64), the excessive pressure deforms the elastic member 25 (as shown in FIG. 1B) and moves the holder 11 back (i.e., away from the opening 64) slightly inside the sleeve 2, thus reducing the excessive pressure in the sleeve 2. The axial length of the cut-out 18 in the threaded member 8 is preferably designed to allow axial movement of the catch 17 over a distance approximately equal to the axial deformation of the elastic member 25. Preferably, the elastic member 25 is capable of being axially deformed up to about a few millimeters. As the elastic member 25 is deformed downwardly, air under the elastic member 25 is correspondingly compressed. Preferably, the air compressed under the elastic member 25 is expelled via an unsealed region between the actuating member 4 and the sleeve 2. In an alternate embodiment, a vent 43 (see FIGS. 2A–2B and 3A–3B) is provided in a bottom portion of the actuating member 4.

Preferably, almost all of the excessive pressure is absorbed by the elastic member 25, thereby significantly reducing the excessive pressure force on the closure 27. Because the excessive pressure is decreased somewhat automatically, the closure 27 can be designed for easy removal without the risk that the closure 27 will become accidentally disengaged from the sleeve 2. Although the above discussion specifically refers to excessive pressure created by positioning the closure 27 on the sleeve 2, excessive pressure can also result from temperature increases inside the dispenser 1. Regardless of the cause of the excessive pressure, the elastic member 25 will preferably absorb at least part of the excessive pressure in the dispenser, as described above.

Figure 2A:
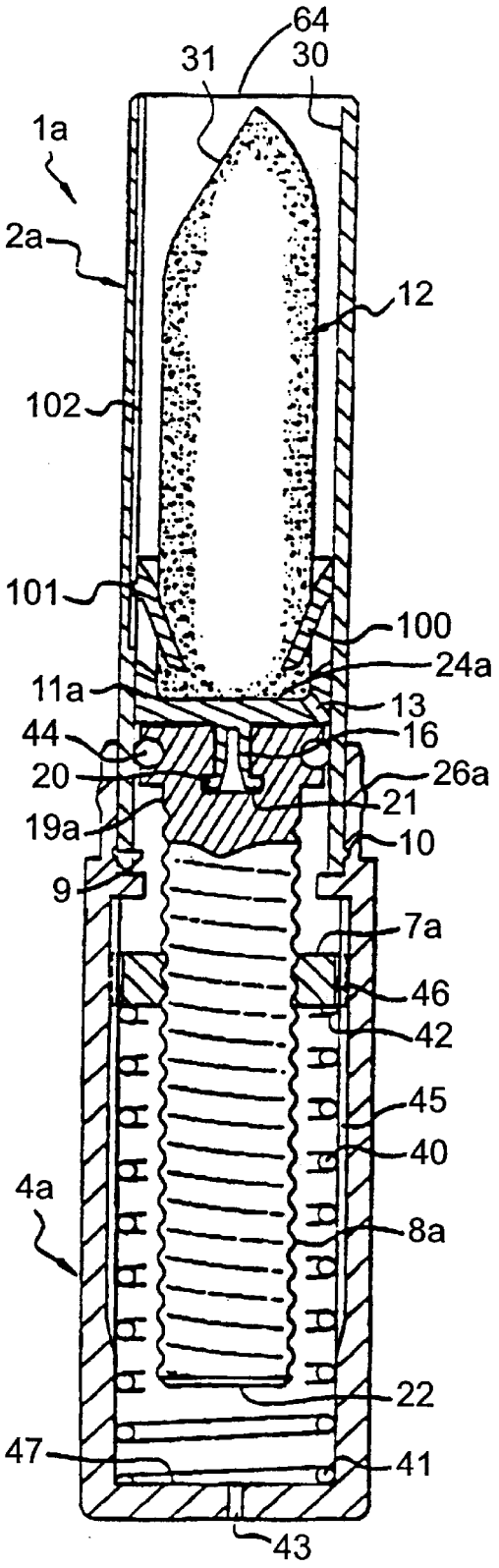
FIGS. 2A and 2B show a second embodiment of the dispenser.
Figure 2B:
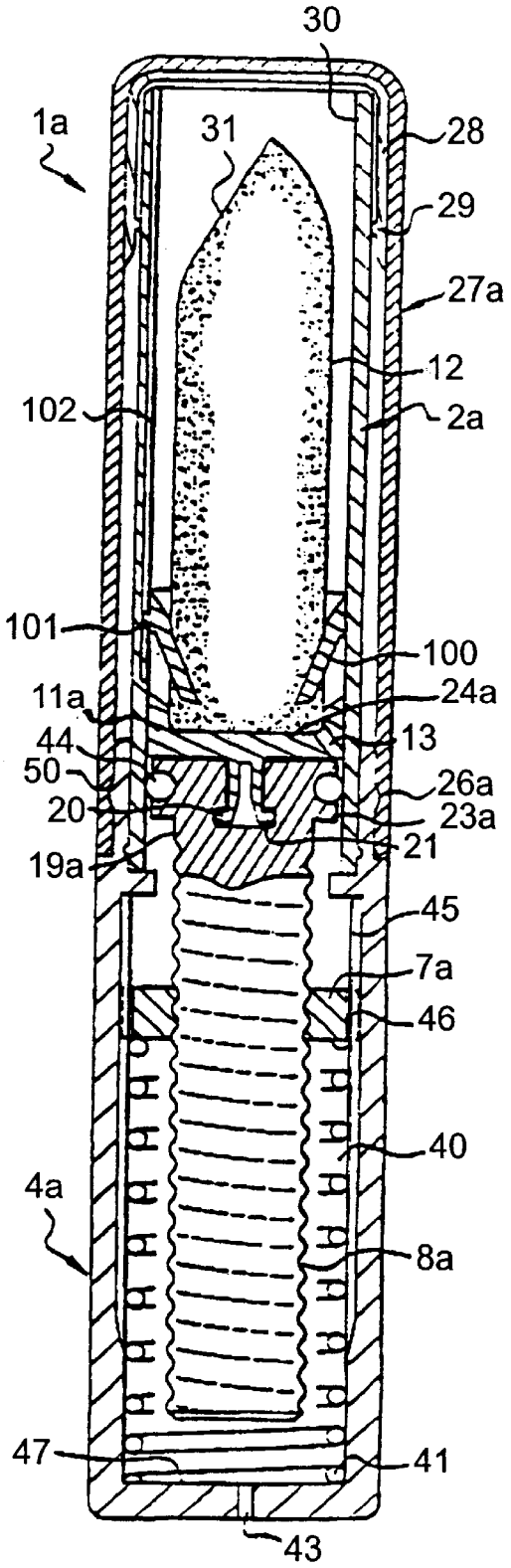

FIGS. 2A and 2B show an embodiment of a dispenser 1*a* for a stick of product. The elastic member of the dispenser 1*a* is a helical spring 40 instead of the block of foam illustrated in FIGS. 1A and 1B. A first end 42 of the spring 40 supports a receiving member 7*a* and a second end 41 of the spring 40 is on a bottom portion 47 of an actuating member 4*a*. The receiving member 7*a* preferably sits freely on the first end 42 of the spring 40. Preferably, the receiving member 7*a* is coupled to the actuating member 4*a* so that the receiving member 7*a* does not rotate relative to the actuating member 4*a*. For example, a longitudinal slot 45 on the inner surface of the actuating member 4*a* receives a portion 46 of the receiving member 7*a* to rotatably couple the receiving member 7*a* to the actuating member 4*a*.

Preferably, the spring 40 is made of metal and/or thermoplastic material. The compression resistance (i.e., elasticity) of the spring 40 is preferably configured to be less than the catching force of the groove 50 of the closure 27*a* and the rib 26*a* of the sleeve 2*a* so that the spring 40 absorbs at least some of the excessive pressure that may result from replacing the closure 27*a* on the sleeve 2*a*. In one embodiment, the bottom portion 47 of the actuating member 4*a* includes an insert to facilitate molding and assembly of the dispenser;

Compared to the embodiment of FIGS. 1A and 1B, the axial height of the actuating member 4*a* is larger to allow placement of the spring 40 therein. In addition, the rim 26*a* of the cap 27*a* is on the actuating member 4*a* rather than on the sleeve 2*a*, as in the first embodiment. As stated above, the embodiment shown in FIGS. 2A and 2B includes a vent 43 on the bottom portion 47 of the actuating member 4*a* to allow air that is compressed during compression of the spring 40 to flow out of the dispenser.

A sealing member 44 is preferably positioned about the periphery of a transverse plate 23*a* (FIG. 2B) on an end 19*a* of a threaded member 8*a*. The sealing member 44 is preferably an O-ring made of an elastomeric material.

A lower portion 24*a* of a holder 11*a* is preferably in direct contact with the transverse plate 23*a*. Preferably, the holder 11*a* does not rotate or translate relative to the transverse plate 23*a*. The holder 11*a* is preferably coupled to the sleeve 2*a* by a lug 101 provided on the outer surface of the holder 11*a* so that the holder 11*a* does not rotate relative to the sleeve 2*a*. Preferably, the lug 101 slides in a longitudinal slot 102 on the inner surface of the sleeve 2*a*. In an alternate embodiment, the threaded member 8*a* is coupled to the sleeve 2*a* by a friction force between the sealing member 44 and the inner surface of the sleeve 2*a* so that the threaded member 8*a* does not rotate relative to the sleeve 2*a*. In another embodiment, the holder 11*a* and the threaded member 8*a* are a single piece.

The holder 11*a* preferably includes a positioning member 100 to position the stick of product on the holder 11*a*. Preferably, the positioning member 100 includes a plurality of uniformly spaced fingers projecting radially inwardly from an outer portion of the holder 11*a* to hold the stick of product on the holder 11*a*. In the alternative, the positioning member 100 may include only one finger. The positioning member 100 is preferably molded as a part of the holder 11*a*. This configuration is particularly advantageous when the stick of product is cast directly on the holder 11*a*.

The stick of product 12 is moved from the storage position to the application position in the same way as with the previous embodiment (i.e., by rotating the actuating member 4*a* relative to the sleeve 2*a* ). Any excessive pressure in a region between the sealing member 44 and the rim 29, particularly after replacing the closure 27*a* on the sleeve 2*a*, compresses the spring 40 (see FIG. 2B) to relieve at least a portion of the excessive pressure. When the spring 40 is compressed by excessive pressure, the holder 11*a*, the threaded member 8*a*, and the receiving member 7*a* move toward the bottom portion 47 of the actuating member 4*a*. Air compressed by the movement of the seal 44 away from opening 64 is expelled via the vent 43 on the bottom portion of the actuating member 4*a*.

Figure 3A:
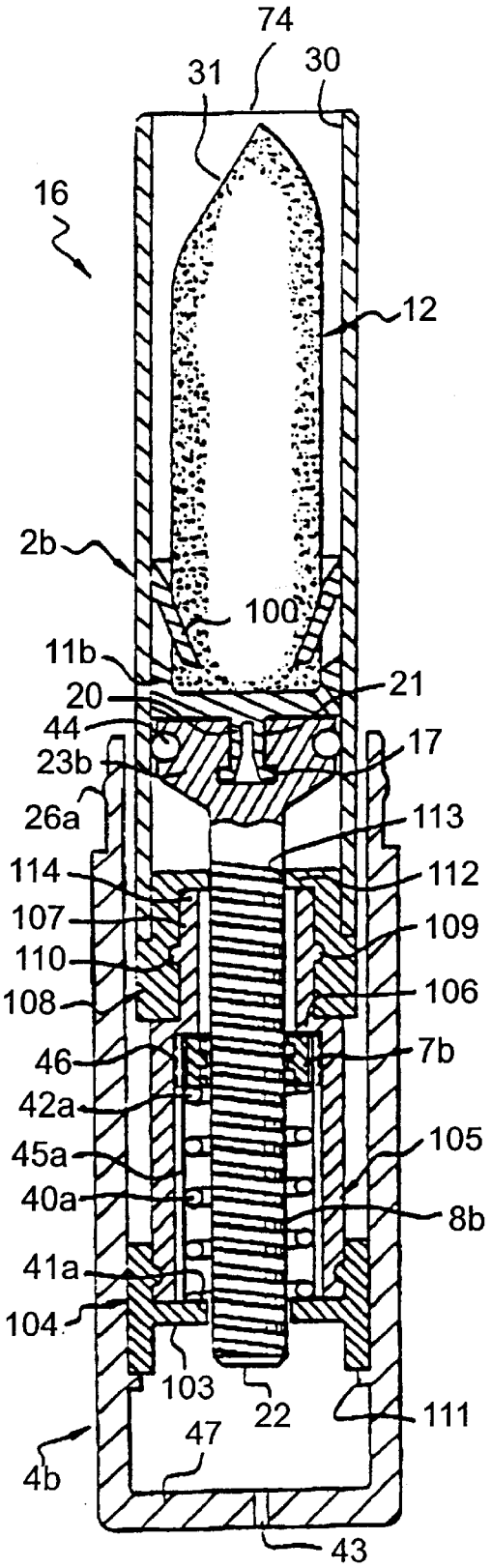
FIGS. 3A–3B show a third embodiment of the dispenser.
Figure 3B:
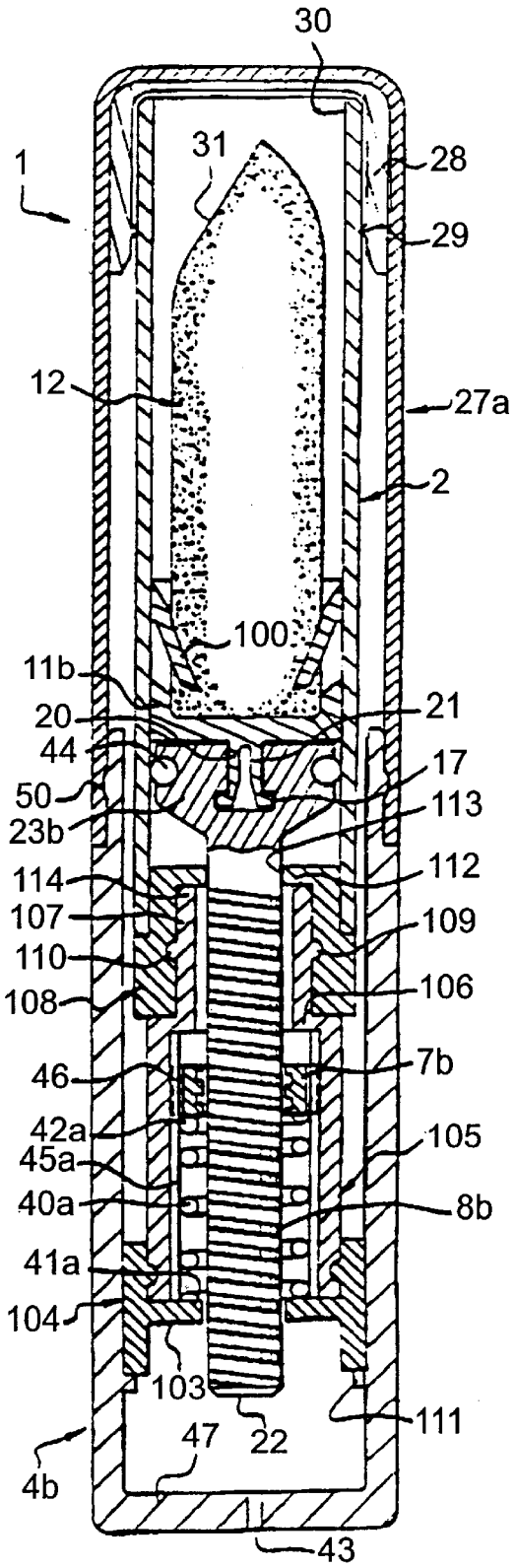

FIGS. 3A–3B show an embodiment similar to the embodiment shown in FIGS. 2A and 2B. In this embodiment, a fitting piece 104 is inserted into an actuating member 4*b*. The fitting piece 104 is rotatably coupled to (i.e., coupled so that it does not rotate relative to) the actuating member 4*b*. A stop 111 on the actuating member 4*b* facilitates positioning of the fitting piece 104 within the actuating member 4*b*. An intermediate piece 105, rotatably coupled to the fitting piece 104, is preferably snap-fit onto the fitting piece 104. The intermediate piece 105 defines a cylindrical space that receives a spring 40*a*. A first end 42*a* of the spring 40*a* supports a receiving member 7*b* and a second end 41*a* of the spring 40*a* is on an annular portion 103 of the fitting piece 104. The receiving member 7*b*, similar to the receiving members 7, 7*a*, has threads configured to engage a threaded member 8*b*.

In the absence of excessive pressure, the spring 40*a* biases the receiving member 7*b* against a shoulder 106 on the intermediate piece 105. The receiving member 7*b* is preferably rotatably coupled to the intermediate piece 105 (and therefore rotatably coupled to the actuating member 4*b* ). For example, a longitudinal slot 45*a* on an inner surface of the intermediate piece 105 receives a portion 46 of the receiving member 7*b* to rotatably couple the receiving member 7*b* to the intermediate piece 105.

The threaded member 8*b* preferably has a non-circular (i.e., having a flattened portion or rectangular) cross-section over at least part of its length. The threaded member 8*b* is configured to engage the threads of the receiving member 7*b*. An upper portion 107 preferably extends from the intermediate piece 105. Preferably, the upper portion 107 has a diameter smaller than the remainder of the intermediate piece 105. An annular rim 110 on an outer surface of the upper portion 107 is preferably configured to snap-fit onto an annular groove 109 on an inner surface of a guiding piece 108. When the annular rim 110 is on the groove 109, the guiding piece 108 is preferably free to rotate relative to the intermediate piece 105. Preferably, a shoulder 112 (bent to approximately 90°) of the guiding piece 108 is positioned above a free edge 114 of the upper portion 107. The shoulder 112 defines an opening 113 having a cross-section similar to the non-circular cross-section of the threaded member 8*b*. The shape of the opening 113 preferably prevents the threaded member 8*b* from rotating relative to the guiding piece 108, while allowing the threaded member 8*b* to move axially up and down relative to the receiving member 7*b*.

A sleeve 2*b* is positioned on the guiding piece 108. The threaded member 8*b* preferably includes a transverse plate 23*b*. An outer periphery of the transverse plate 23*b* preferably carries the sealing member 44. In a preferred embodiment, the sealing member 44 is an O-ring. A holder 11*b* is positioned on the plate 23*b*. In one embodiment, the holder 11*b* is capable of rotating relative to the plate 23, while in another embodiment, the holder 11*b* is not capable of rotating relative to the plate 23. The holder 11*b* is similar to the holder 11*a* of the embodiment shown in FIGS. 2A and 2B. The remaining elements of the dispenser 1*b* are similar to corresponding elements of the embodiment shown in FIGS. 2A and 2B.

To use this device, the user removes the closure 27*a* and rotates the actuating member 4*b* relative to the sleeve 2*b* to move the stick of product 12 from the storage position to the dispensing position. By rotating the actuating member 4*b*, the receiving member 7*b* rotates relative to the threaded member 8*b*, which is unable to rotate relative to the sleeve 2*b*. Thus, the threaded member 8*b* rises axially in the sleeve 2*b*, thereby pushing the holder 11*b* axially upwardly until the free surface 31 of the stick of product 12 emerges from the sleeve 2*b* via the opening 74. After application of the product to a surface, the user rotates the operating member 4*b* in the opposite direction to return the stick of product 12 to the storage position within the sleeve 2*b*. The user then replaces the closure 27*a* on the sleeve 2*b*. Any excessive pressure in a region between the sealing member 44 and the rim 29, particularly excessive pressure caused by replacing the closure 27*a* on the sleeve 2*b*, compresses the spring 40*a* (see FIG. 3B) to relieve at least a portion of the excessive pressure. When the spring 40*a* is compressed by excessive pressure, the holder 11*b*, the threaded member 8*b*, and the receiving member 7*b* move toward the bottom portion 47 of the actuating member 4*b*. Air compressed between sealing member 44 and bottom portion 47 is expelled via the vent 43 on the bottom portion 47 of the actuating member 4*b*.

It will be apparent to those skilled in the art that various modifications and variations can be made to the structure and methodology of the present invention without departing from the spirit or scope of the invention.

In view of the foregoing, it is intended that the present invention cover modifications and variations of this invention, provided they fall within the scope of the following claims and their equivalents.

What is claimed is:

1. A dispenser for dispensing a stick of product, comprising:

a holder configured to hold the stick of product;

a housing containing the holder, the housing having a first end, a second end, and an opening in the first end, and the housing being configured to move the holder in a first direction toward the opening to allow dispensing of the product and in a second direction away from the opening to allow storage of the product;

a removable closure including a sealing element configured to sealably close the opening during storage of the product;

a sealing member sealing at least a portion of the housing between the holder and the opening from at least a portion of the housing between the holder and the second end; and an elastic member between the holder and the second end of the housing, the elastic member being configured to deform and thereby allow for movement of the holder in the second direction when excessive pressure is formed between the holder and the opening.

2. The dispenser of claim 1, wherein the elastic member has the shape of a bellows.

3. The dispenser of claim 1, wherein the sealing element comprises an insert in the closure.

4. The dispenser of claim 3, wherein the insert is formed of a thermoplastic material.

5. The dispenser of claim 1, wherein the sealing element forms a seal by contacting the housing.

6. The dispenser of claim 1, wherein the sealing element comprises a rim.

7. A dispenser for dispensing a stick of product, comprising:

a holder configured to hold the stick of product;

a housing containing the holder, the housing having a first end, a second end, and an opening in the first end, and the housing being configured to move the holder in a first direction toward the opening to allow dispensing of the product and in a second direction away from the opening to allow storage of the product;

a removable closure including a sealing element configured to sealably close the opening during storage of the product;

a sealing member sealing at least a portion of the housing between the holder and the opening from at least a portion of the housing between the holder and the second end;

an elastic member between the holder and the second end of the housing, the elastic member being configured to deform and thereby allow for movement of the holder in the second direction when excessive pressure is formed between the holder and the opening; and a threaded member coupled to the holder and a receiving member having threads configured to engage the threads of the threaded member, the holder moving in the first direction and in the second direction when the receiving member is rotated relative to the threaded member.

8. The dispenser of claim 7, wherein the housing includes a sleeve configured to contain the holder and an actuating member coupled to the sleeve so that the actuating member is capable of being rotated relative to the sleeve.

9. The dispenser of claim 8, wherein the receiving member is on the actuating member.

10. The dispenser of claim 8, wherein the receiving member is coupled to the actuating member to preclude relative rotation therebetween and the threaded member is coupled to the sleeve to preclude relative rotation therebetween.

11. The dispenser of claim 8, wherein the actuating member includes a bottom portion, and wherein the elastic member includes a first end supporting the receiving member and a second end on the bottom portion.

12. The dispenser of claim 8, wherein the threaded member is a threaded rod and the receiving member is a nut.

13. A dispenser for dispensing a stick of product, comprising:

a housing including a first portion and a second portion coupled to one another so that the first and second portions are rotatable with respect to one another, the second portion having an opening;

a removable closure configured to sealably close the opening in the second portion of the housing;

a holder configured to hold a stick of product, the holder being in the housing and being coupled to the housing so that rotation of the first portion with respect to the second portion provides dispensing movement of the holder toward the opening and storage movement of the holder away from the opening; and an elastic member in the housing, the elastic member being coupled to the holder so that excessive pressure in the housing causes a force that deforms the elastic member to allow pressure absorption movement of the holder, with respect to the first and second portions, in a direction away from the opening, wherein the elastic member and the closure are configured such that a force required to deform the elastic member and thereby allow movement of the holder in the second direction is less than a force required to remove the closure from a sealably closed position on the housing.

14. The dispenser of claim 13, wherein the closure includes a groove engageable with a rib on the housing to sealably close the opening.

15. The dispenser of claim 14, wherein the force required to remove the closure from the sealably closed position on the housing is a catching force between the groove and the rib.

16. A dispenser for dispensing a stick of product, comprising:

a housing including a first portion and a second portion coupled to one another so that the first and second portions are rotatable with respect to one another, the second portion having an opening;

a removable closure including a sealing element configured to sealably close the opening in the second portion of the housing;

a holder configured to hold a stick of product, the holder being in the housing and being coupled to the housing so that rotation of the first portion with respect to the second portion provides dispensing movement of the holder toward the opening and storage movement of the holder away from the opening; and an elastic member in the housing, the elastic member being coupled to the holder so that excessive pressure in the housing causes deformation of the elastic member to allow pressure absorption movement of the holder, with respect to the first and second portions, in a direction away from the opening; and a pressure release mechanism disposed in the housing configured to release excessive pressure in the housing resulting from movement of the holder in the second direction.

17. A dispenser for dispensing a stick of product, comprising:

a holder configured to hold the stick of product;

a housing containing the holder, the housing having a first end, a second end, and an opening in the first end, and the housing being configured to move the holder in a first direction toward the opening to allow dispensing of the product and in a second direction away from the opening to allow storage of the product;

a removable closure configured to sealably close the opening during storage of the product;

a sealing member sealing at least a portion of the housing between the holder and the opening from at least a portion of the housing between the holder and the second end; and an elastic member between the holder and the second end of the housing, the elastic member being configured to deform and thereby allow for movement of the holder in the second direction in response to a force on the elastic member when excessive pressure is formed between the holder and the opening, wherein the elastic member and the closure are configured such that a force required to deform the elastic member and thereby allow the movement of the holder in the second direction is less than a force required to remove the closure from a sealably closed position on the housing.

18. The dispenser of claim 17, wherein the elastic member includes at least one of a block of foam and an elastomeric material.

19. The dispenser of claim 8, wherein the elastic member includes at least the block of foam, the block of foam including at least one of polyvinyl chloride foam, polyurethane foam, polyether foam, natural rubber foam, and synthetic rubber foam.

20. The dispenser of claim 8, wherein the elastic member includes at least the elastomeric material, the elastomeric material including at least one of silicone elastomers, nitrile elastomers, and Polynorbordene®.

21. The dispenser of claim 17, wherein the elastic member is a spring.

22. The dispenser of claim 17, wherein the sealing member is a sealing lip on an edge of the holder.

23. The dispenser of claim 17, wherein the sealing member is an O-ring.

24. The dispenser of claim 17, wherein the closure includes a thermoplastic insert, the thermoplastic insert sealing the opening of the housing when the closure engages the housing.

25. The dispenser of claim 17, wherein the holder includes a vent near a lower portion of the holder, the vent allowing air to flow out of the holder when a stick of product is positioned on the holder.

26. The dispenser of claim 17, wherein the holder includes a positioning member to position the stick of product on the holder.

27. The dispenser of claim 26, wherein the positioning member includes at least one finger projecting radially inwardly from an outer portion of the holder.

28. The dispenser of claim 17, wherein the housing includes a vent located in the second end.

29. The dispenser of claim 17, wherein the holder is cup-shaped, the holder including a lower portion and at least one side wall.

30. The dispenser of claim 17, further comprising a stick of product on the holder.

31. The dispenser of claim 30, wherein the stick of product is chosen from lipstick, a stick of foundation, and a stick of treatment composition.

32. The dispenser of claim 17, wherein the closure is configured to at least occasionally cause the excessive pressure between the holder and the opening when the closure seals the opening.

33. The dispenser of claim 17, wherein the housing comprises a first section and a second section rotatable with respect to one another, the first and second sections being configured so that rotation of the first section in one direction moves the holder in the first direction and rotation of the first section in an opposite direction moves the holder in the second direction.

34. The dispenser of claim 17, wherein the sealing member is coupled to the holder such that the sealing member moves along with the holder when the holder moves in the first and second directions.

35. The dispenser of claim 17, wherein the closure includes a groove engageable with a rib on the housing to sealably close the opening.

36. The dispenser of claim 35, wherein the force required to remove the closure is a catching force between the groove and the rib maintaining the closure on the housing to sealably close the opening.

37. A method of limiting excessive pressure in a dispenser, comprising:

providing the dispenser of claim 17 and a stick of product in the holder;

removing the closure from the opening;

applying the product to a surface;

sealably closing the opening with the closure; and deforming the elastic member when excessive pressure develops between the holder and the opening to thereby absorb at least a portion of the excessive pressure.

38. The method of claim 37, further comprising moving the holder axially within the housing after the closure is removed to expose the stick of product from the housing.

39. The method of claim 38, further comprising moving the holder axially within the housing to store the stick of product after applying the product to the surface.

40. The method of claim 37, wherein the stick of product is chosen from lipstick, a stick of foundation, and a stick of treatment composition.

41. A dispenser for dispensing a stick of product, comprising:

a holder configured to hold the stick of product;

a housing containing the holder, the housing having a first end, a second end, and an opening in the first end, and the housing being configured to move the holder in a first direction toward the opening to allow dispensing of the product and in a second direction away from the opening to allow storage of the product;

a removable closure including a sealing element configured to sealably close the opening during storage of the product;

a sealing member sealing at least a portion of the housing between the holder and the opening from at least a portion of the housing between the holder and the second end;

an elastic member between the holder and the second end of the housing, the elastic member being configured to deform and thereby allow for movement of the holder in the second direction when excessive pressure is formed between the holder and the opening; and a pressure release mechanism disposed between the sealing member and the second end of the housing for releasing excessive pressure in the housing resulting from movement of the holder in the second direction.

42. The dispenser of claim 41, wherein the pressure release mechanism includes an air vent for providing escape of air between the sealing member and the second end of the housing when the holder moves in the second direction.

43. A dispenser for dispensing a stick of product, comprising:

a holder configured to hold the stick of product;

a housing containing the holder, the housing having a first end, a second end, and an opening in the first end, and the housing being configured to move the holder in a first direction toward the opening to allow dispensing of the product and in a second direction away from the opening to allow storage of the product;

a removable closure configured to close the opening during storage of the product;

a sealing element configured to cooperate with the removable closure to sealably close the opening during storage of the product;

a sealing member sealing at least a portion of the housing between the holder and the opening from at least a portion of the housing between the holder and the second end; and an elastic member between the holder and the second end of the housing, the elastic member being configured to deform and thereby allow for movement of the holder in the second direction when excessive pressure is formed between the holder and the opening.

44. The dispenser of claim 43, wherein the sealing element comprises an insert in the closure.

45. The dispenser of claim 44, wherein the insert is formed of a thermoplastic material.

46. The dispenser of claim 43, wherein the sealing element forms a seal by contacting the housing.

47. The dispenser of claim 43, wherein the sealing element comprises a rim.

* * * * *

UNITED STATES PATENT AND TRADEMARK OFFICE

CERTIFICATE OF CORRECTION

PATENT NO. : 6,340,258 B2
DATED : January 22, 2002
INVENTOR(S) : Jean-Louis H. Gueret It is certified that error appears in the above-identified patent and that said Letters Patent is hereby corrected as shown below:

Column 12,
Line 4, replace "claim 8" with -- claim 18 --.
Line 9, replace "claim 8" with -- claim 18 --.

Signed and Sealed this

Fourteenth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,340,258 B2
DATED : January 22, 2002
INVENTOR(S) : Jean-Louis H. Gueret It is certified that error appears in the above-identified patent and that said Letters Patent is hereby corrected as shown below:

Column 12,
Line 4, replace "claim 8" with -- claim 18 --.
Line 9, replace "claim 8" with -- claim 18 --.

Signed and Sealed this

Fourteenth Day of May, 2002

*Attest:*

*Attesting Officer*

JAMES E. ROGAN
*Director of the United States Patent and Trademark Office*